United States Patent [19]

Coron

[11] Patent Number: 5,073,750

[45] Date of Patent: Dec. 17, 1991

[54] REMOTE CONTROL APPARATUS FOR INSTALLATION OF ELECTRICAL TOY AND CIRCUIT

[75] Inventor: Jean-Pierre Coron, Dampierre et Flee, France

[73] Assignee: Jouef Industries S.A., Champagnole, France

[21] Appl. No.: 472,238

[22] Filed: Jan. 30, 1990

[30] Foreign Application Priority Data

Jan. 31, 1989 [FR] France ..... 89 01565
Jun. 7, 1989 [FR] France ..... 89 07748

[51] Int. Cl.[5] ..... A63H 30/04; A63H 19/24

[52] U.S. Cl. ..... 318/58.7; 318/16; 318/6; 340/825.72; 246/167 R; 246/187 R; 446/444; 446/454

[58] Field of Search ..... 318/138, 560–646, 318/16, 6; 901/1, 2; 364/424.01, 424.02, 513; 180/167, 168, 169; 340/825.69, 825.64, 825.72, 825.76; 246/34 B, 44, 167 R, 187 R, 187 A, 187 B, 182 R; 446/90, 96, 444, 445, 454, 456, 455; 104/295

[56] References Cited

U.S. PATENT DOCUMENTS

| | | | |
|---|---|---|---|
| 4,390,877 | 6/1983 | Curran | 446/455 |
| 4,449,114 | 5/1984 | Fascenda et al. | 180/168 X |
| 4,572,996 | 2/1986 | Hanschke et al. | 318/16 X |
| 4,791,570 | 12/1988 | Sherman et al. | 318/587 |
| 4,902,948 | 2/1990 | Sherman et al. | 318/580 |

FOREIGN PATENT DOCUMENTS

| | | |
|---|---|---|
| 2741154 | 3/1979 | Fed. Rep. of Germany . |
| 3301732 | 7/1984 | Fed. Rep. of Germany . |
| 3309662 | 9/1984 | Fed. Rep. of Germany . |
| 1494132 | 7/1967 | France . |
| 2315295 | 1/1977 | France . |
| 2364667 | 4/1978 | France . |
| 2380048 | 9/1978 | France . |

OTHER PUBLICATIONS

Copy of Radio Mento, vol. 30, No. 6, Jun. 1964, pp. 488–493, entitled "Frensteuranlagen".

*Primary Examiner*—Paul Ip
*Attorney, Agent, or Firm*—Sandler, Greenblum & Bernstein

[57] ABSTRACT

A remote control device for an installation of electrical toys on a circuit comprises a radio emitter (400) for emitting different radio-electric signals (b) selected by the user and a fixed radio receiver (450) for detecting and transmiting the radio-electric signals to an electronic device (270) which interprets the signals and triggers a control device (275). Specifically, the radio signal (b), which is emitted by the radio emitter, comprises a repetition of a word composed of a series of presences or absences of electric pulses. The word is formed according to an associated coded signal (a) and in accordance with the user's selection.

13 Claims, 1 Drawing Sheet

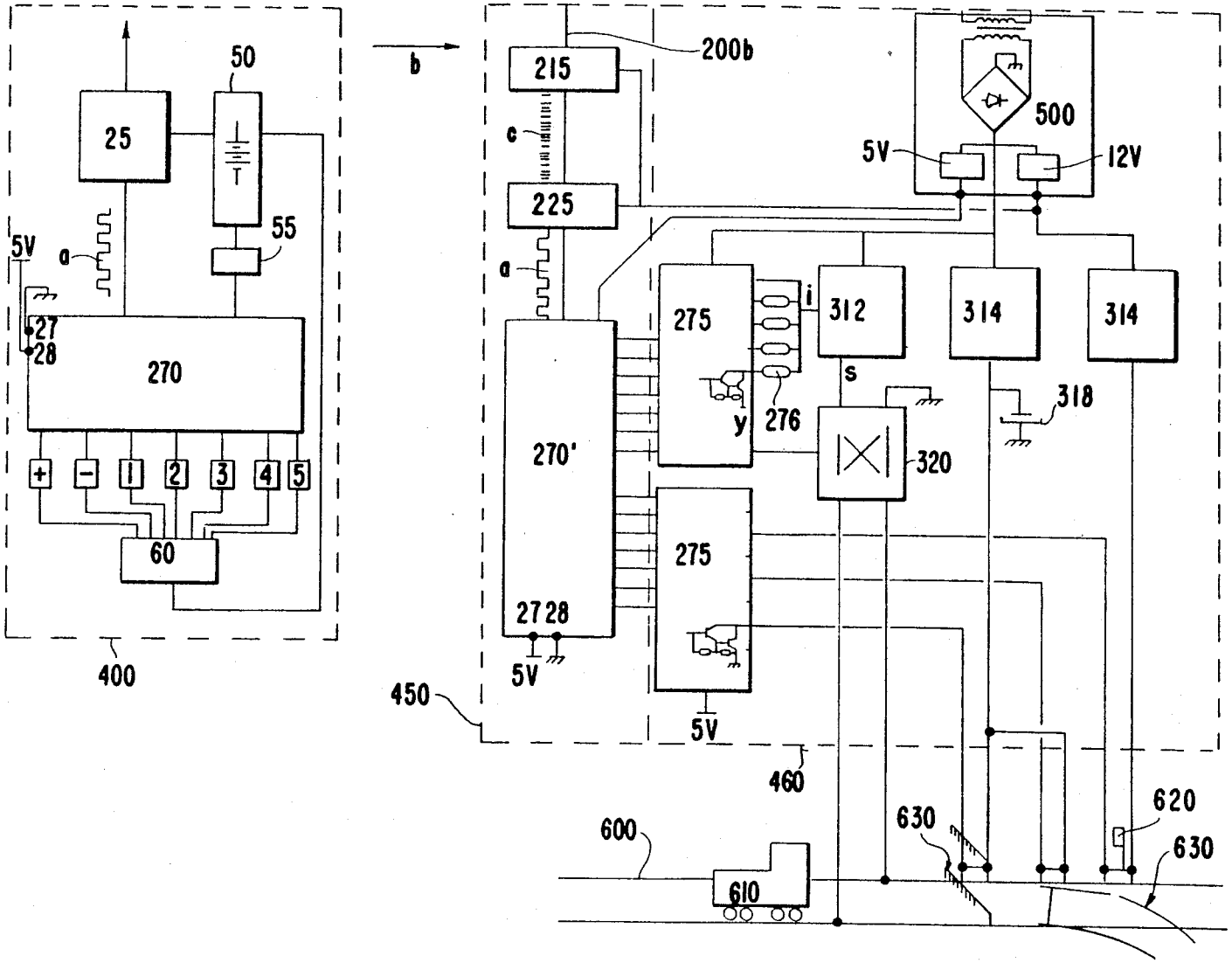
500
12V
5V
314
314
318
312
320
s
i
276
y
275
275
5V
200b
215
225
c
a
270'
27 28
5V
450
460
620
630
630
610
600
b
50
55
25
270
60
1
2
3
4
5
+
−
a
27
28
5V
400

REMOTE CONTROL APPARATUS FOR INSTALLATION OF ELECTRICAL TOY AND CIRCUIT

BACKGROUND OF THE INVENTION

1. Field of the Invention

The present invention relates to a remote control device for an installation of electrical toys, comprising, for example an electric train or automobile. To simplify the description, the invention will be described more particularly in relation to an electric train.

2. Description of the Related Art

Such installations comprise at least one rail circuit for guiding one or more electric motor-driven models and for supplying electrical energy thereto as well as a first associated electrical device for transforming mains electrical energy, and also for regulating, modulating and supplying to this electrical energy to the motor incorporated in the model(s). For example, for locomotives having a d.c. motor, there is provided in series a transformers for reducing the mains electrical voltage, a rectifier circuit for producing direct current, a rheostat for adjusting the voltage applied to the circuits and thus altering the speed of the locomotive, and an inverter relay for changing the polarity of the electric current applied to each rail, hence reversing the direction of rotation of the locomotive's motor.

The installation may be completed with one or more on/off type accessories, i.e. accessories that are either supplied (on) or not supplied (off), for instance lighting or signal lights. An electrical device which comprises, for example, simple switches connected to the output of the rectifier circuit, may be provided for permanently supplying and controlling these accessories with electrical energy.

This installation may further be provided with one or several accessories such as barriers comprising an electromagnetic coil that can trip from one state to another in response to reception of a pulse of short duration. In this case, a third electronic device for generating, controlling and suppling these accessories with electrical pulses should be provided, and may be made up from various elements including a capacitor and switches.

In addition to the special interest of train enthusiasts for some sophisticated model installation layouts, the main interest in these model train installations resides in the management and coordination of their proper running. Constant progress has been made in control devices for such installations.

As described in W. German specification DE 3 309 669 (ROTH), it is presently possible to simultaneously control from a single control, panel, movement about fifteen locomotives as well as the states of a hundred or so accessories, while at the same time also memorizing various repetitive actions and monitoring the electrical consumption. For this, data-processing means, housed in a control panel, interpret commands directly keyed into a keyboard and generate orders in the form of digital signals transmitted through the rail circuit, which enables the elimination of the former unsightly cable networks.

However, even with such an installation, which is also costly because of its complexity, the user (railway enthusiast or child) must permanently remain in front of the central control panel, and therefore can only have a partial view of his layout. The can be awkward when rapid decisions must be taken, and may frequently lead to boredom after a short time. On the other hand, a model railway that can be controlled from several discrete control stations is subject to other more serious problems, because of the impossibility of actuating another control panel when the operator happens to be situated on the other side of the installation.

In W. German specification DE 2 741 154, Messrs. MAERKLIN attempt to increase children's alertness and renew interest for railway enthusiasts by freeing them from their central control panel, thus being able to appreciate their installation from several vantage points. To accomplish this, an analog radio control is provided similar to those used for model airplanes, having a receiver placed between the transformer and the switch box.

But, as described in the periodical "RADIO MENTOR" of June 1964, page 488, such a radio control is normally designed to constantly transmit radio waves control a small number of continuous on/off devices. For this, an authorization or licence must be obtained from the telecommunication authorities before acquiring the equipment, which is also costly because of its complexity. Then, the receiver must be adapted to the switch box in order to make use of the different possibilities of the transmitter, which is by no means straightforward.

In a radio control device adapted for various types of models, described in French specification FR 2 380 048 KUBRICK, the problem of the limited number of commands that can be transmitted because of interference between close frequencies characterizing each transmission channel is resolved by including in the emitter and the receiver microprocessors enabling a series of binary words made up of a defined number of bits to be used as a radio signal. Although it may be possible to use this device in the open country, the device rapidly becomes inoperative in town, in a house, and more particularly, for a model circuit installation because the surrounding electrical interference can distort the binary words in such a manner that the effect produced may be the opposite to or quite different than what was desired.

W. German specification DE 3 301 732 of MULTIPLEX discloses an emitter for the radio control of models comprising a microprocessor connected to memories containing pre-recorded instructions and function operators. Apart from generating binary radio signals, the microprocessor may also be used for configuring the emitter to control different types of other models, such as planes, boats or automobiles. This possibility only appears to be advantageous for well-informed model enthusiasts with knowledge of computers who are willing to invest in a polyvalent emitter, but not for a member of the general public interested solely in his recently purchased model circuit.

SUMMARY OF THE INVENTION

An object of the present invention is to provide a remote control device for a model circuit installation, comprising a radio emitter and receiver in which greatest advantage is taken of the polyvalence of microprocessors and their methods of control to obtain a device that performs even better in this context. Of course, such a device must remain efficient, and it must have a sufficient operating range to allow the user to stand back without having to aim towards any particular point with the emitter in hand, while remaining reliable for all emitted commands. Moreover, the device must not interfere with the surroundings, to insure compliance with strict norms which might make the product unattractive to sell to the public at large. This device must also remain simple to understand in its use because it is intended for a public including children. Last, and above all, as for many other toys, it must be possible to manufacture the device according to the invention at very low cost.

These objects are achieved by means of a remote control device for an installation of electrical toys on a circuit of the aforementioned type, which device comprises a portable radio emitter and a fixed radio receiver. The portable radio emitter contains a succession of switches connected to a voltage source as well as a microcomputer whose input terminals are respectively connected to the switches. The microcomputer includes means for storing different pre-established codes, and a microprocessor for associating, with a signal received from a switch selectively actuated by the user, an address of the storage means containing a corresponding code, and then applying to an output circuit a corresponding binary signal. The fixed radio receiver also contains a microcomputer for receiving on an input terminal a binary signal and interpreting this signal to trigger first and/or second and/or third control means of the device. More specifically, the radio emitter further comprises fourth electronic means for amplifying and reprocessing the binary signal into an emitted signal that is less sensitive to surrounding electrical interference. The fixed radio receiver comprises fifth electronic means for converting the received signal into a binary signal that it applies to the input of its microcomputer.

A "fixed" radio receiver forms part of and is connected to the rail circuit layout, as opposed to a radio emitter which is portable, i.e., hand-held by the user and movable freely throughout the surroundings. Usually, the receiver will be secured and form part of the fixed installation, or it may simply be placed at a given location of the installation. It may even be incorporated in a mobile element providing this element is suitably connected to the rail circuit.

According to a first feature, the radio emitter emits a radio-electric signal only in response to selection by the user.

According to another feature, a radio-electric signal emitted by the radio emitter is made up essentially of a repetition of a binary word composed of a succession of presences or absences of electrical pulses according to an associated coded signal selected by the user.

Preferably then, the fourth electronic means of the emitter amplifies and reprocesses the binary signal into an emitted signal. The fourth electronic means comprises a fixed-frequency oscillator including an element serving as antenna. The fourth electrical means is respectively switched on and off by applying the reduction of, a coded voltage to its input terminal by means of an output circuit of the microcomputer.

Preferably, the fifth electronic means of the fixed radio receiver comprises in succession, an oscillator having the frequency of its output signal modulated by radio signals received by an antenna, and a demodulator. The demodulator-decoder comprises a frequency comparator for forming a coded signal from the output signal received by the oscillator, and the coded signal is applied to one of the input circuits of the microcomputer.

According to another feature, control means are provided to control an accessory, wherein the control means comprises one or a plurality of electronic switches connected between the accessory and ground, and the control means is directly controlled by an output circuit of the microcomputer.

According to another feature, the first electronic means modulates the electrical energy of the rail circuit, and comprises a modulator whose control gate is connected to at least two resistors each connected to a voltage source through an electronic switch that is controlled directly by an output circuit of the microcomputer.

Advantageously, at least one of the electronic switches is in the form of a Darlington transistor connection.

According to an advantageous method of controlling the microcomputer, in generation of a signal selecting an acceleration, the microcomputer modifies the state of the switches associated with the resistors to increase by one unit the control voltage at the input of the modulator, until all of the resistors have been supplied.

According to another advantageous method of controlling the microcomputer, upon reception of a signal corresponding to selection of a deceleration, the receiver microcomputer:

modifies the state of the switches to reduce by one unit the control voltage at the input of the modulator and tests if the last switch is open.

If the previous test is positive, the microcomputer controls triggering of the inverter means to produce a stop, which is possibly timed, then a change of direction of the motor-driven model.

Another advantageous method of controlling the microcomputer of the radio receiver, during self-initialisation of this microcomputer following the first application of voltage, consists of this microcomputer waiting until a first switch is actuated by the user, then writing in the storage means a family of codes pre-recorded as a function of the first actuated switch.

Another advantageous method of controlling the microcomputer of the radio-emitter, during self-initialisation of this microcomputer following the first application of voltage, consists of this microcomputer waiting until a first radio-electric signal has been received, then writing in the storage means the family of pre-recorded codes corresponding to this first signal.

According to another advantageous feature, the microcomputers of the radio emitter and of the fixed radio receiver are each provided in the same semiconductor topography, the connection upon assembly of one or several input terminals to one or several reference potentials determining the configuration, as "emitter microcomputer" or "receiver microcomputer", adopted by the topography.

BRIEF DESCRIPTION OF THE DRAWING

The invention is hereinafter described in greater detail with reference to an embodiment of an electric train set given by way of non-limiting example and illustrated by the single accompanying Figure showing a block diagram of the device.

DESCRIPTION OF THE PREFERRED EMBODIMENTS

In the lower part of the Figure is schematically shown a portion of a railway circuit 600 on which a motor-driven model, namely a locomotive 610, runs. In the case of an automobile circuit, the motor-driven model would be an automobile. In this portion of the circuit are included two accessories 630 responsive to electric pulses, namely a level crossing and a points switch. This portion of the circuit also comprises an accessory of the "all or nothing" type, namely an illumination lamp or a signal light 620. This installation is supplied by a unit 460 in which are generated, regulated and controlled the various electrical energies necessary for the installation. The remote control device of this supply unit 460 comprises on the one hand a portable radio emitter 400 and on the other hand a fixed radio receiver 450 whose outputs are connected to the control means of the supply block 460. In practice, the fixed radio receiver 450 and this supply unit 460 are fixed inside the same housing.

The supply unit 460 comprises firstly a circuit 500 for transforming the mains electricity supply into low-voltage direct current. Usually, this circuit 500 includes a transformer reducing the mains voltage to about 18 V, followed by a rectifier diode bridge delivering this same voltage as d.c.. Two electronic regulators also enable voltages of 12 and 5 V respectively to be derived from this first voltage of 18 V.

A second circuit of unit 460 provided to supply the rails 600 is made up of a modulator 312 connected at one end to the 18 V of unit 500 and at the other end to the first input of an inverter switch 320 whose other input is connected to ground. The two outputs of this inverter swtich 320 are connected to respective rails of circuit 600.

Modulator 312 delivers, at its output (s), a d.c. voltage comprised between 0 and 14 V depending on the control voltage at gate (i). This gate (i) is connected to four resistors 276 in parallel and which are respectively connected at the other end to switches each configured as a Darlington transistor connection. This gate (i) is moreover directly connected to a fifth switch again configured as a Darlington transistor connection. These five transistor assemblies are respectively controlled by five independent outputs of a microcomputer 270' forming part of a fixed radio receiver 450 described below. Thus, by different combinations of opening and closing these switches, it is possible to apply at will to the gate (i) a control voltage with thirty two discrete values, thus providing as many discrete values for the output voltage (s).

By means of the inverter relay 320 the polarity between the two rails can be modified depending on the signal applied to its control gate (i'). For safety reasons, a mechanical relay is preferred rather than an electrical relay. Likewise, the control gate (i') is connected to a switch configured as a Darlington transistor connection itself controlled by sixth output circuit of the microcomputer 270' of radio receiver 450.

In pratice, eight Darlington transistor connections are brought together in a single housing, for instance a unit commercialized by Messrs. THOMSON under reference ULN 2803, schematically shown as units 275.

A third circuit of unit 460 for supplying the accessories 620 operating in "all or nothing" mode is made up of a current limiting circuit 314 connected at one end to the 12 V of unit 500 and at the other end to the first terminal of accessory 620, the other terminal being connected to ground via a switch identical to the previous one, i.e. as a Darlington transistor connection directly piloted by an output circuit of the microcomputer 270' of the radio receiver 450. The advantage of arranging this switch close to ground is that a low control voltage is sufficient to switch it. For example, the circuit 314 may comprise an electronic component whose impedance varies as a function of the difference of potential at the output and the potential at a control gate. A low-resistance resistor is thus placed behind this electronic component but before the accessory 620 and an electrical connection delivers the potential at the output of this resistor to the control gate of the electronic component. It is easy to understand that the difference between the potential at the output and that at the control gate is equal to the potential drop produced by the flow of current through the resistor and thus is truly representative of the strength of the direct current flowing through the accessory. Therefore, if this current strength tends to become too great for example because the accessory 620 is short-circuited, the impedance of the electronic component increases automatically which decreases this strength. For example, the electronic component may be one commercialized by Messrs. THOMSON under reference LN 317.

A fourth circuit of unit 460 designed to supply the pulse-operated accessories 630 comprises another current-limiting circuit 314 similar to the previously-described one, connected at one end to the 18 V of unit 500 and at the other end to the first terminals of each of the accessories 630. Furthermore, a high-capacitance capacitor 318 is connected at one end to the output of this circuit 314 and at the other end to ground. Finally, all of the second terminals of accessories 630 are respectively connected to switches, always in the form of Darlington transistor connections, which connections are contained together in a lower second housing 275. In fact, each accessory 630 comprises two discrete circuits: one for actuating, the other for de-actuating, two switches being provided per accessory. In this fourth circuit, the capacitor 318 is provided for storing a sufficient electrical charge to generate a brief pulse but with a strong current, about one Amp, when a switch is closed while its circuit 314 carries a maximum current of the order of 300 milliamps. In other words, the capacitor 318 can only be charged when all of the switches of accessories 630 are open and a charging current can flow, controlled by circuit 314.

The portable radio emitter 400 is schematically shown on the left of the Figure. This emitter comprises a microcomputer 270, i.e. an electronic component containing in the same housing a microprocessor, also called central processing unit, communicating via an internal data transfer line known as a "bus" with a passive ROM memory which stores data relating to action procedures (or microprocessor programs), an active RAM memory in which the necessary data for stages of actions can be written and read, as well as several series of input and/or output buffer circuits depending on the destinations or functions attributed by the program. This microcomputer is supplied at 5 V from a battery 50 by means of a voltage adapting and regulating circuit 55.

Two input circuits designated by 27 and 28 are connected respectively to ground and to the circuit 55. Seven of the input buffer circuits are respectively connected to switches "1" to "5", "+" and "−", the latter all being connected to a circuit 60 delivering from battery 50 a voltage compatible with the input circuits. Furthermore, one of the output buffer circuits is connected to the input of a fixed-frequency oscillator circuit 25 including one element serving as antenna and another element for adjusting this frequency. By way of nonlimiting example, this oscillator circuit may be composed on the one hand of a simple transistor whose base forms the circuit's input, whose emitter is connected to ground and whose collector is connected to the battery 50 via a damping coil and on the other hand of an oscillator circuit, such as a parallel connection of capacitors and a coil serving as antenna, connected between the transistor's collector and base.

The corresponding fixed radio receiver 450 comprises a first oscillator 215 having the frequency of its output signal (c) modulated by the radio-electric signals (b) received by an antenna 200*b*. Advantageously, this antenna 200*b* may also be the "plus" rail of the rail circuit 600. This output signal (c) is applied to the input of a demodulator-decoder circuit 225 comprising a frequency comparator whose output signal (a) is applied to one of the input circuits of a microcomputer 270'. As before, this microcomputer comprises a single housing containing a microprocessor connected via an internal "bus" line to a passive ROM memory for storing data relating to the action sequence of the microprocessor and to an active RAM memory in which data necessary for operation of the microprocessor can be written and read, the input buffer circuit connected to the demodulator 225, as well as several output buffer circuits that are respectively connected to the switches 275 mentioned during the description of the supply unit 460. Finally, two input circuits (or gates) 27 and 28 are connected to the 5 V supply and to ground respectively. The circuits 215 and 225 are supplied with 12 V and the microcomputer 270' with 5 V from the circuit 500 of unit 460.

The microcomputers in the emitter and the receiver may be of a known type, such as the model EF68HC commercialized by Messrs. THOMSON. However, once the operating procedures have been adequately set up and for cost reasons, it is possible to envisage designing a single semiconductor topography having the same functions. Because of the similarity of the architecture of the two microcomputers, and because the only differences reside essentially in the relatively simple operation set up by the pre-recorded procedures in the ROM memories, it can be envisaged that a single topography could be designed that would be fitted indifferently in the emitter or in the receiver, and with the particular connection of one or two input gates such as 27, 28 ensuring that only the necessary part of the operating procedure is brought into action.

The above-described remote control device operates as follows.

When a battery 50 is fitted in the radio emitter 400, the microcomputer 270 firstly enters an initialization procedure which is read from the ROM memory. During this procedure, its microprocessor tests the state of the input circuits 27 and 28 and determines that an "emitter" role has been assigned to it during installation. Then this microprocessor passes to a waiting mode until one of the buttons "1"-"5", "+" or "−" is actuated a first time by the user. According to the actuated button, the microprocessor writes into the active RAM memory the corresponding family of pre-established codes. In other words, the microcomputer initially has seven families of codes available in a ROM memory but later makes use of only one in a RAM memory. This allows use of another portable radio emitter 400 that can be used in the surroundings, taking care however to select another code by actuating the first time a different one of the switches.

Once this very rapid self-initialisation has been completed, the radio emitter 400 is ready for use. Thus, as soon as one of the buttons is pressed in again, the microprocessor of microcomputer 270 responds to a change of state of the corresponding input buffer circuit and associates with this received signal an address of the active RAM memory, and applies the corresponding code to the output circuit that delivers a coded signal (a) to the input of oscillator 25.

Advantageously, this signal (a) may be a succession of a word made up of a series of absences or presences of square waves of the order of 5 V. The first part of the word may characterize the family of codes used while the second part instead characterizes the button that has been pressed. For example, a half word may be made up of a succession of eight square waves one of which is repeated (doubled), the position of this double square wave in relation to the others characterizes the data: family of codes, button.

Taking into account that on the one hand the oscillator 25 starts as soon as its input gate is at a sufficient potential and stops as soon as its input gate drops back to a potential close to zero and on the other hand that this oscillator operates at a high frequency much greater than that of the coded signal (a), it is understood that upon receiving this signal (a) the oscillator 25 emits a radio-electric signal (b) composed of a series of the presence or absence of identical packets of pulses, each of these packets corresponding to a square wave. In other words, the radio signal (b) reproduces the coded signal (a) with the difference that the square waves are now replaced by packets of pulses of high frequency.

Taking into account the speed of generation of radio electric waves by the radio emitter 400 relative to the speed of movement of a finger on the button even for a very brief movement, it is quite clear that a series of similar words will be systematically emitted and not a single long word. This phenomena is essentially due to the frequency of operation of the microprocessor being easily followed by the frequency of the oscillator that has deliberately been selected very high because of norms to be respected and in order to avoid interference with other permanent radio electric emissions. For example, this emitting frequency is much greater than 110 MHz constituting the upper limit of emission of modulated-frequency radio waves. Lastly, it should be noted that the power applied to the antenna is small, of the order of 0.5 mW, providing very economical use of the battery 50, limiting as far as possible interference outside the building while providing a sufficient emission for the receiver 450. A low-consumption LED lamp associated with the emitter's antenna enables verification of the proper functioning of the emitter.

This radio electric signal (b) is received by an antenna 200*b* at the input of oscillator 215 and alters its oscillation frequency. For instance, this oscillator goes from a normal frequency of 4 MHz to a second frequency of 2 MHz when packets of pulses are received. The frequency-modulated signal (c) is then applied to a demodulator-decoder comprising a frequency comparator and delivering a voltage of 5 V for the normal frequency and 0 V for the other and which, at the output, reconstitutes the signal (a) previously generated in the radio emitter 400. This signal (a) is then applied to the input of the microcomputer 270'.

During the initial energization of the central control panel, and thus of the microcomputer 270', the latter also firstly goes through a self-initialisation procedure that is read from its ROM memory. During this procedure, its microprocessor firstly tests the state of the input circuits 27 and 28 and establishes that a "receiver" role has been assigned to it during installation. Then, this microprocessor waits for reception of a first signal of which it reads only the first part characterizing the family of codes set up in the emitter and which it in turn writes in identical fashion in its active memory with the codes of the associated buttons. Once this self-initialisation phase has been completed, the following signals (a) will be interpreted to recognize the corresponding button that has been pressed in. During this interpretation, tests may be carried out to check the authenticity of the received signal. For example, given that the duration of the square waves has been set at a value much greater than the usual duration of interference, one test may consist of verifying that a square wave forming part of a signal (a) transmitted by the demodulator-decoder 225 has a given minimum duration.

The next signal (a) is read by the microprocessor of microcomputer 270' and compared with the codes previously recorded in the storage means (for instance the RAM). If no code corresponds to the second half-word received, the microprocessor equates this with interference and rejects it, i.e. it waits for reception of a new signal. If, however, the second half-word received corresponds to one of the predetermined codes, the microprocessor equates this with whichever button of the radio emitter that has been pressed in. The microprocessor can then operate according to the user's orders.

If one of the "1" to "5" buttons is pushed in, the microcomputer 270' applies either a pulse or a saturation state to the output terminal connected with the corresponding switch of the lower housing 275. The associated accessory is then triggered in the usual manner.

If the microcomputer 270' senses that the "+" button has been pressed in, it modifies the state of the switches contained in the upper housing 275 to increase by a discrete amount the control voltage at the gate (i) of modulator 310 which thus increases by one increment the voltage applied to the railway installation, hence the speed of the locomotive. If after a waiting time fixed for example at 8/10ths of a second, the word corresponding to the "+" button is still present at the input of microprocessor 270', this microprocessor realizes that the acceleration must be pursued and modifies the state of the switches again until the five gates are in the 1 (or high) state. This waiting time can be established in such a manner that full acceleration of the locomotive takes place in five seconds.

If, however, the microcomputer 270' senses that the "−" button has been pressed, it modifies the state of the switches contained in the upper housing 275 to reduce by a discrete amount the control voltage at the gate (i). Furthermore, the microcomputer 270' tests whether the last gate switched is not also the first of the series corresponding to zero speed. In this case, persistence of the word corresponding to the "−" button at the input of the microcomputer 270' means that the direction of motion of the locomotive must be reversed and the corresponding gate at the input (i') of the inverter relay 320 is changed.

It should be noted that simultaneous pressing in of the "+" and "−" buttons corresponds to a particular code generating a series of characteristic words that are then interpreted in the microcomputer 270' to mean an emergency stop.

In comparison with known radio-operated remote controls for model aeroplanes, this device has a reduced number of circuits while the form of the radio-electric signal enhances the immunity of the transmission to interference from the surroundings.

As set out above, this remote control device allows the user to move around his model train installation while continuing to transmit orders to the previously-described supply unit incorporated in unit 460. Apart from convenience in decision taking because of a better view of a local situation, this device increases the interest of many enthusiasts who can now appreciate and admire all details of their their complex installations, and for a low cost. Furthermore, this device now enables installations that need no longer be confined to a single room, but may extend through several rooms or outside thereby increasing the user's pleasure.

I claim:

1. In an installation of electrical toys having a circuit of the type comprising at least one conductive rail for guiding one or more electric motor-driven models and for supplying electrical energy to the models, first electrical means for respectively transforming, regulating, and modulating mains electrical energy and supplying the conductive rail with the electrical energy, means adapted to receive one or more ON/OFF type accessories, second electrical means for supplying electrical energy to the ON/OFF type accessories, means adapted to receive one or more pulse operated accessories, each being responsive to electric pulses, and third electrical means for generating electric pulses to control said pulse operated accessories, a remote control device comprising:

a portable radio emitter comprising a succession of switches connected to a voltage source and an emitter microcomputer having a plurality of input circuits connected to respective ones of said switches, said emitter microcomputer including means for storing different pre-established codes and a microprocessor for associating a signal received from one of said switches selectively actuated by the user with an address of said storage means containing a corresponding code, the microcomputer applying said corresponding code to an output circuit in the form of a first binary signal, a fixed radio receiver which comprises a receiver microcomputer having an input circuit for receiving a second binary signal and means for interpreting said second binary signal to trigger at least one of said first, second and third electrical means of the device, wherein said radio emitter further comprises fourth electrical means for amplifying and reprocessing said first binary signal into an emitted signal which is less sensitive to surrounding electrical interference, and wherein the fixed radio receiver comprises fifth electrical means for receiving said emitted signal and converting said emitted signal into said second binary signal, said fifth electrical means comprising means for applying said second binary signal to an input of said receiver microcomputer.

2. A device according to claim 1, wherein said radio emitter emits a radio signal only in response to a selection by a user.

3. A device according to claim 1, wherein said radio signal emitted by said radio emitter comprises a repetition of binary words formed of a succession of presences or absences of electrical pulses according to an associated coded signal selected by the user.

4. A device according to claim 1, wherein said fourth electrical means of the emitter comprise a fixed-frequency oscillator including an element serving as antenna, said oscillator being respectively switched on and off by the presence or absence of a coded voltage at an input terminal of said oscillator applied by the output circuit of said emitter microcomputer.

5. A device according to claim 1, wherein the fifth electrical means comprises, in series, an oscillator for producing an output signal whose frequency is modulated by radio signals received by an antenna, and a demodulator-decoder, said demodulator-decoder comprising a frequency comparator for forming a coded signal from said output signal received from said oscillator, said coded signal being applied to one of the input circuits of said receiver microcomputer.

6. A device according to claim 1 adapted to cooperate with a rail installation comprising at least one accessory, wherein said second electrical means comprise one or a plurality of electronic switches connectable between said at least one accessory and ground, said electronic switches being directly controlled by an output circuit of said receiver microcomputer.

7. A device according to claim 1, wherein said first electrical means comprises a modulator having a control gate connected to at least two resistors each connected to a voltage source through an electronic switch which is controlled directly by an output circuit of said receiver microcomputer.

8. A device according to claim 6, wherein at least one of said electronic switches comprises a Darlington transistor connection.

9. A device according to claim 7, wherein, in response to a signal corresponding to selection of an acceleration of a model present at an input of said receiver microcomputer, said receiver microcomputer modifies the state of ones of said switches which are associated with said resistors to increase by one unit the control voltage at the input of said modulator, until all of said resistors have been supplied.

10. A device according to claim 7, wherein in response to a signal corresponding to a selection of deceleration of a model, said receiver microcomputer modifies the state of said switches to reduce by one unit the control voltage present at the input of said modulator;

tests if a last one of said switches is open; and if the previous test is positive, controls triggering of an inverter means to stop a controlled model on the rail circuit for a period of time, and thereafter move the controlled model in a different direction.

11. A device according to claim 1, wherein, during self-initialization of said emitter microcomputer following the first application of voltage, a waiting period is provided until a first of said switches is actuated by the user, whereby a family of codes pre-recorded, as a function of the first actuated switch, is written into said storage means.

12. A device according to claim 1, wherein, during self-initialization of said receiver microcomputer following a first application of voltage, a waiting is provided period until a first radio signal has been received, whereby the family of pre-recorded codes corresponding to the first applied voltage is written into said storage means.

13. A device according to claim 1 wherein said emitter microcomputer and said receiver microcomputer each comprise the same semiconductor topography, and wherein the connection, upon assembly, of one or several input terminals of each of said emitter microcomputer and said receiver microcomputer to one or several reference potentials, determines the configuration as emitter microcomputer or receiver microcomputer adopted by the topography.

* * * * *